US007269917B2

(12) United States Patent
Dempsey

(10) Patent No.: US 7,269,917 B2
(45) Date of Patent: Sep. 18, 2007

(54) DISPLAY INSERT

(76) Inventor: Martha A Dempsey, 7579 First Pl., Cleveland, OH (US) 44146

( * ) Notice: Subject to any disclaimer, the term of this patent is extended or adjusted under 35 U.S.C. 154(b) by 43 days.

(21) Appl. No.: 10/696,112

(22) Filed: Oct. 29, 2003

(65) Prior Publication Data

US 2005/0091889 A1 May 5, 2005

(51) Int. Cl.
*G09F 21/04* (2006.01)

(52) U.S. Cl. ..... 40/587; 40/360

(58) Field of Classification Search ..... 40/539, 40/587, 495; 301/37.102, 37.101, 37.34, 301/37.29, 37.103, 37.104, 37.108, 37.42, 301/37.109

See application file for complete search history.

(56) References Cited

U.S. PATENT DOCUMENTS 1,231,059 A * 6/1917 Pente ..... 446/488
1,434,155 A * 10/1922 Scherotto ..... 40/666
2,177,467 A * 10/1939 Sunderhauf ..... 40/571
2,177,947 A * 10/1939 Riley ..... 40/587
2,614,351 A * 10/1952 Mullen ..... 40/587
2,632,268 A * 3/1953 Schroeder ..... 40/587
2,742,724 A * 4/1956 Fleiss ..... 428/72
3,141,252 A * 7/1964 Mullen ..... 40/587
6,641,225 B1 * 11/2003 Amodeo, Jr. ..... 301/37.103
6,692,058 B1 * 2/2004 Micco ..... 296/77.1
6,846,046 B2 * 1/2005 Brown ..... 301/37.103

FOREIGN PATENT DOCUMENTS

JP 2003316264 A * 11/2003
JP 2005007903 A * 1/2005

* cited by examiner

*Primary Examiner*—Cassandra Davis
(74) *Attorney, Agent, or Firm*—McDonald Hopkins LLC; Robert H. Earp, III

(57) ABSTRACT

Display inserts are often inserted in a product for use as an advertising display. A common use for a display insert is to insert it into the central opening of a tire for use as an advertising display for the tire. The disclosed display insert includes a front panel section. The display unit further includes a rear panel section connected to the front panel section. The rear panel section includes a plurality of tabs.

20 Claims, 10 Drawing Sheets

DISPLAY INSERT

FIELD OF THE INVENTION

This invention pertains to a display insert that can be inserted into a product for use as an advertising display. More specifically, the invention relates to a point-of-purchase display insert that inserts into a tire and serves as an advertising display.

BACKGROUND OF THE INVENTION

Display inserts, such as those used in tires on display at a tire retailer, are used as advertising displays that can generally fit within the center of a tire to provide consumers information regarding that tire. Tire display inserts provide a more desirable aesthetic look to a tire on display by covering the center of a tire.

Tire display inserts are rather common. Generally, there are several types of displays. The most common display is a display formed from a foam core or heavy gauge styrene material. Advertising can be printed either directly onto the foam core or styrene material. Alternatively, advertising can be printed on a press sheet. The press sheet is then affixed onto the foam core or styrene material. This type of display further includes two plastic straps affixed to the back side of the foam core or styrene material. The straps attach the display to the tire and support the display within the center of the tire.

One disadvantage to this type of display is that it is costly to manufacture due to the costs of the individual components. For example, the plastic straps attached to the back side of the display are affixed with costly adhesive mounting pads that are most commonly affixed by hand, thereby increasing the manufacturing costs. Additionally, the foam-core or heavy gauge styrene materials are relatively expensive.

Another disadvantage to this type of display is that it can only correctly fit into one specific tire size. In other words, even though this type of tire display insert can fit correctly in one tire size, it will not correctly fit in a different sized tire center. Thus, a tire insert display must be manufactured for each and every different size of tire thereby further increasing production costs.

A further disadvantage for this type of display is that while it is initially simple to setup in the tire, the way in which the display attaches to the tire often leads to failure during use. Specifically, the plastic straps affixed to the back side of the display do not provide enough tension to hold the display in place on the tire over time. Also, the display will not easily stay in proper placement in the center of the tire because of the inadequate tension created between the straps and the body material. In addition, the plastic straps may also break off due to a failure in the adhesive pads holding the straps and back side of the display together. Finally, the components may not re-attach properly if a user attempts to reattach the straps to the display.

Another type of commercially available tire display is a single piece square-shaped display formed from a single layer of styrene or twenty-four point solid bleached sulfate (SBS) material. This display is a very simple design as the corners of the square sheet of material are bent and inserted into the opening of the center of the tire so that the bent corners hold the display into place. This type of display is not aesthetically pleasing since the square shape of the display does not cover portions of the opening on the display. Also, the square display can only fit a particular sized tire but is not suitable for tires having different sizes.

It would therefore be desirable to have a tire display having reduced manufacturing costs. It would also be advantageous to have a display that can fit correctly into the center of various tires of different sizes. It would further be advantageous to have a display that is simple to set-up while exhibiting durability by correctly staying in a proper placement in the center of the tire over a relatively long period of time.

SUMMARY OF THE INVENTION

In one aspect, the present invention is directed to a display insert. The display insert includes a front panel section and a back panel section connected to the front panel section. The back panel section includes a plurality of tabs. The tabs can hold the display insert in the center of a tire and provides a biasing force to hold the display insert securely in place. Preferably, the display insert does not require any additional plastic straps for the securement of the display to a tire. The display insert can fit in a range of tire sizes on display.

In another aspect, the present invention is directed to a tire display having a first panel and a second panel connected to the first panel. The first and second panels are each formed from a corrugated material. Preferably, the corrugated material for each of the first and second panels includes at least one flute layer and at least one liner attached to the flute. The first panel and second panel are preferably connected in a way so that the length of the flute in the first panel is nonparallel to the length of the flute in the second panel.

In a further aspect, the present invention is directed to a tire display having a first front panel and a second back panel connected to the first front panel. The first front panel is of any geometric shape. Preferably, the first front panel is circular. The second back panel includes a plurality of tabs. The first front panel and second back panel are each formed from a corrugated material. The corrugated material for each of the first front panel and second back panel includes at least on flute and at least one liner. The flute of the first front panel is nonparallel to the second back panel. Preferably, the length of the flute of the first front panel is perpendicular to the length of the flute of the second back panel.

In yet another aspect, the present invention is directed to a tire display including a first front panel and a second rear panel connected to the first front panel. The second rear panel includes a plurality of tabs. The tabs of the second back panel are flat and generally parallel with the first front panel in an unused state, whereas the tabs of the second back panel are bent in a use state.

In a further aspect, the present invention is directed to a tire display including a first front panel and a second rear panel. The first front panel includes a liner, a flute, and a lithograph sheet. The second rear panel includes at least one flute and liner, preferably a first liner attached to one side of the flute and a second liner attached to the flute opposite the first side. The liner of the first front panel is attached to a liner from the second rear panel. The first front panel and the second rear panel are attached in such a way that the length of the flute of the first front panel is non-parallel to the length of the flute of the second back panel.

In yet a further aspect, the present invention is directed to a display insert that includes of a front panel and first and second side panels operatively connected to the front panel. The first and second side panels include tabs to secure the tire insert within the inner portion of the tire.

Still other advantages and benefits of the invention will become apparent to those skilled in the art upon a reading and understanding of the following detailed description.

BRIEF DESCRIPTION OF THE DRAWINGS

The invention may take physical form in certain parts and arrangement of parts a preferred embodiment and method of which will be described in detail in this specification and illustrated in the accompanying drawings that form a part hereof, and wherein.

DETAILED DESCRIPTION OF THE PREFERRED EMBODIMENTS

Figure 1:
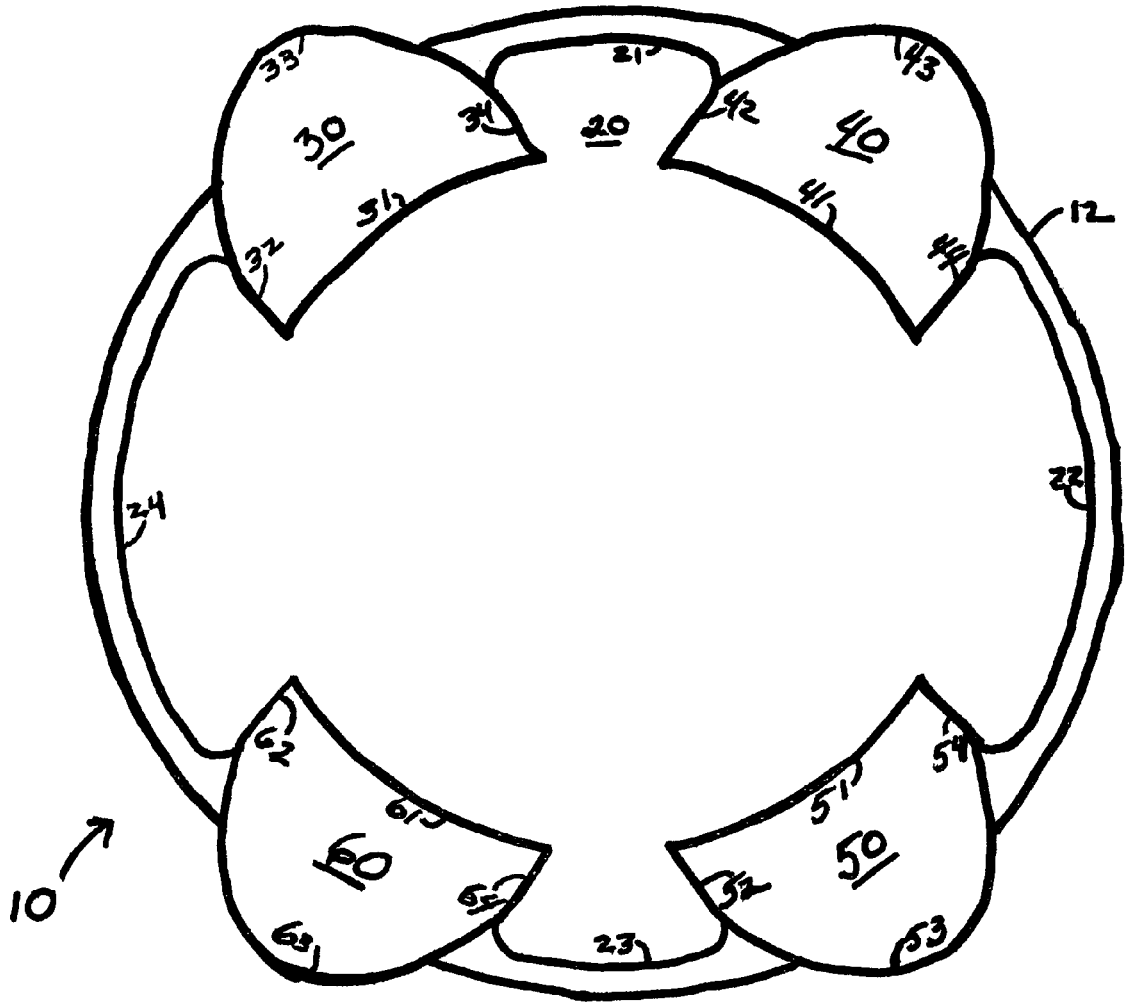
FIG. 1 shows a plan view of the rear side of a tire display 10 in a flat, assembled orientation including a front panel section 12 attached to a back panel section 20.
Figure 2:
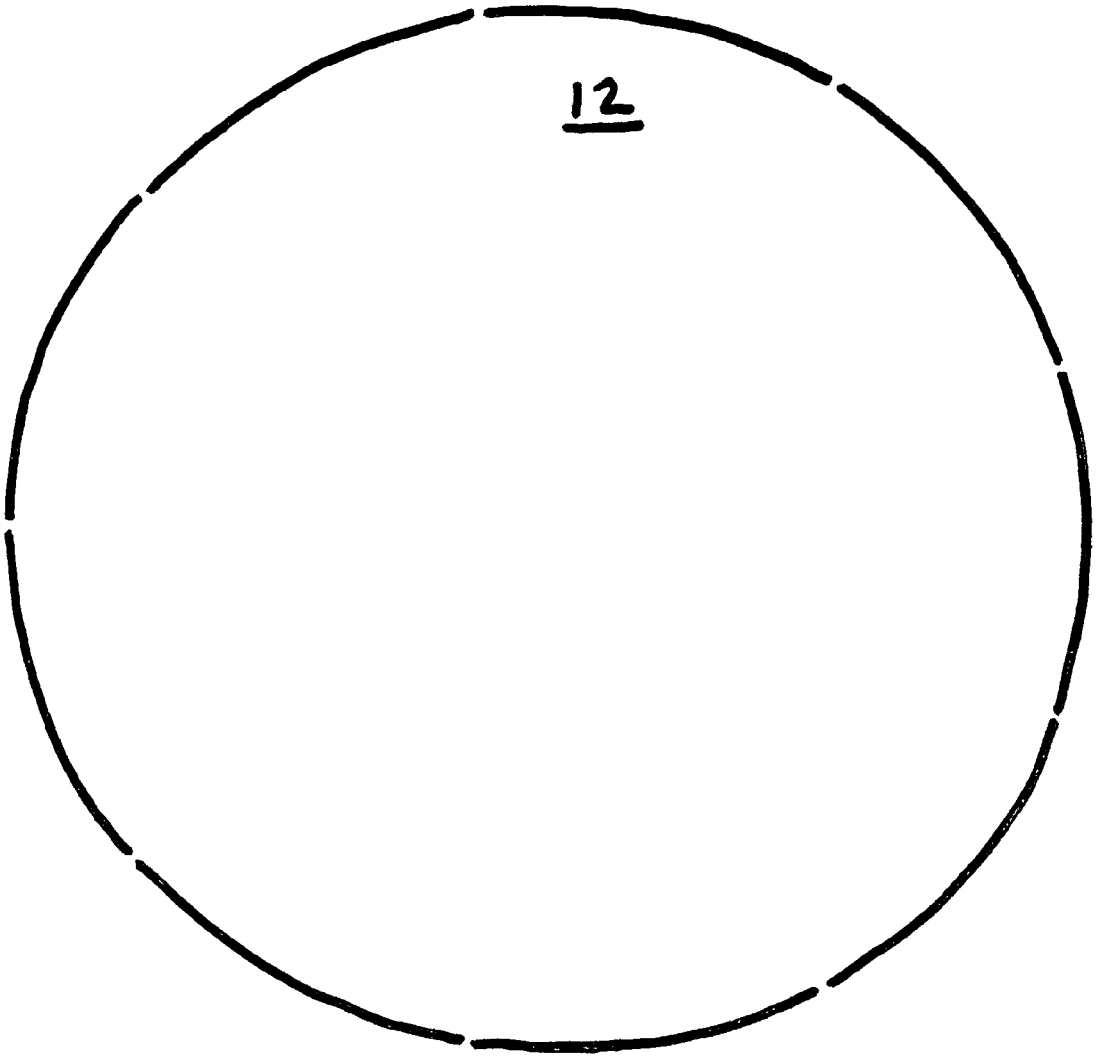
FIG. 2 shows a plan view of the front panel section 12.

Referring now to the drawings wherein the drawings are for purposes of illustrating the preferred embodiments only and not for the purposes of limiting the same:

FIG. 1 shows the rear side of a tire display 10 in a flat assembled position. The display 10 further includes a front panel section 12 and a back panel section 20 that is connected to the front panel section 12. The front panel section 12 can be connected to the back panel section 20 by any known connecting means such as adhesives and staples. FIG. 2 also shows the front panel section 12. Although FIGS. 1 and 2 show the front panel section 12 to be circular, it is contemplated that the front panel section 12 can be of any other geometric or non-geometric shape.

Figure 3:
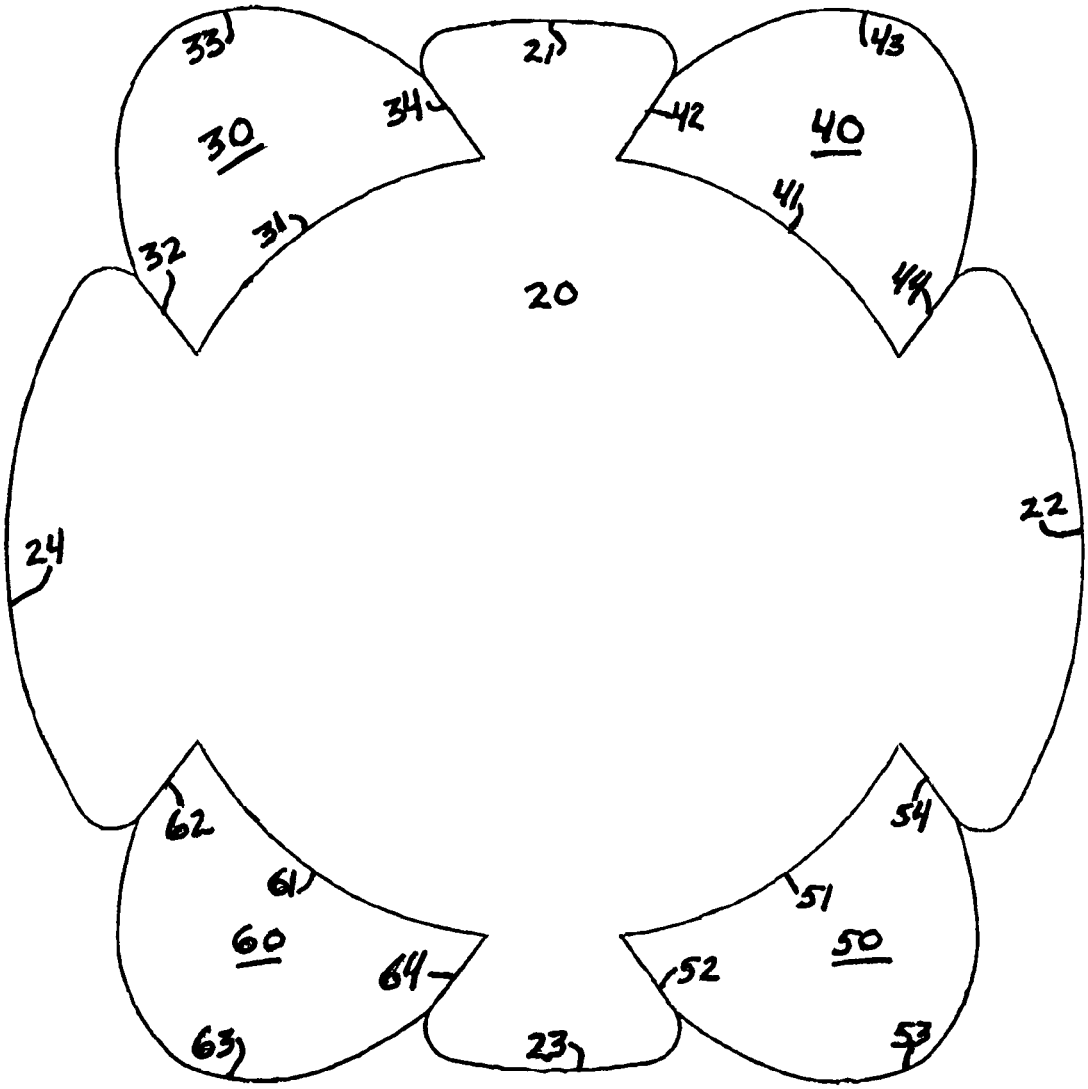
FIG. 3 shows a plan view the back panel section 20.

FIGS. 1 and 3 further illustrate the features of the back panel section 20. The back panel section includes top edge 21, bottom edge 23, and side edges 22, 24. The back panel section includes tab sections 30, 40, 50, and 60 along the edge of the back panel section 20. Tab section 30 is defined by bottom scored edge 31, left side 32, top edge 33 and right side 34. Tab section 40 is defined by bottom scored edge 41, left side 42, top edge 43 and right side 44. Tab section 50 is defined by top scored edge 51, left side 52, bottom edge 53 and right side 54. Tab section 60 is defined by top scored edge 61, left side 62, bottom edge 63 and right side 64. Tab sections 30, 40, 50, and 60 can be bent along scored edges 31, 41, 51 and 61, respectively, so that the tab sections are not parallel and at an angle to the front edge section 12 and the back edge section 20. Tab sections 30, 40, 50 and 60 are bent in order to secure the side wall of a tire (not shown) between the front edge section 12 and the tab sections 30, 40, 50, and 60. Preferably, tab sections 30, 40, 50, and 60 extend beyond the outer diameter of the front panel section 12 to further provide for the proper securement of the display 10 to the tire. Tab sections 30, 40, 50, and 60 can increase or decrease in size if the front portion 12 increases or decreases in size.

Figure 6:
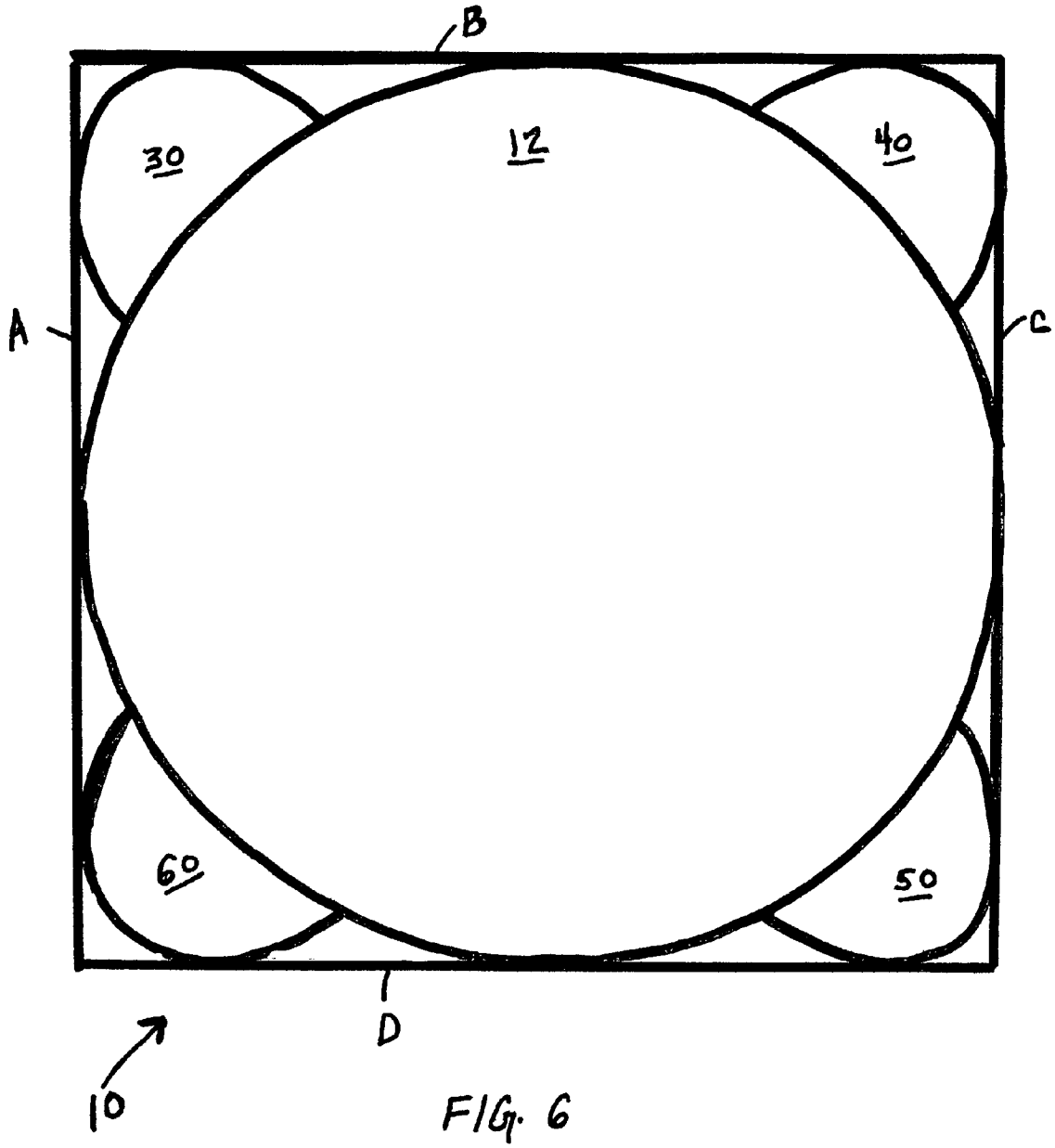
FIG. 6 shows a plan view of the display insert showing that the edges of the tabs are coplanar with the respective edge of the front panel section.

Preferably, the edges of the tabs 30, 40, 50, and 60 on the display 10 are coplanar with the corresponding edge of the front panel 12 so that the display could fit within a square with sides equal to the diameter of the front panel. This preferred feature allows for simpler shipment and storage and lessens the likelihood for the possibility of damage to the display during shipment or storage. FIG. 6 shows the display 10 including a front portion 12 and tab sections 30, 40, 50, and 60. Plane A shows tab sections 30 and 60 are coplanar with the left edge of the front portion 12. Plane B shows tab sections 30 and 40 are coplanar with the top edge of the front portion 12. Plane C shows tab sections 40 and 60 are coplanar with the right edge of the front portion 12. Plane D shows tab sections 50 and 60 are coplanar with the bottom edge of the front portion 12. Planes A, B, C, and D each have a length that is approximately equal to the diameter of the front portion 12. Although the edges of the tabs are coplanar with the respective edges of the front portion, it is also contemplated that the tabs and edges of the front portion are not coplanar. In particular, the present display can have the edges of the tabs extending beyond the corresponding edge of the front portion or vice versa.

Figure 5:
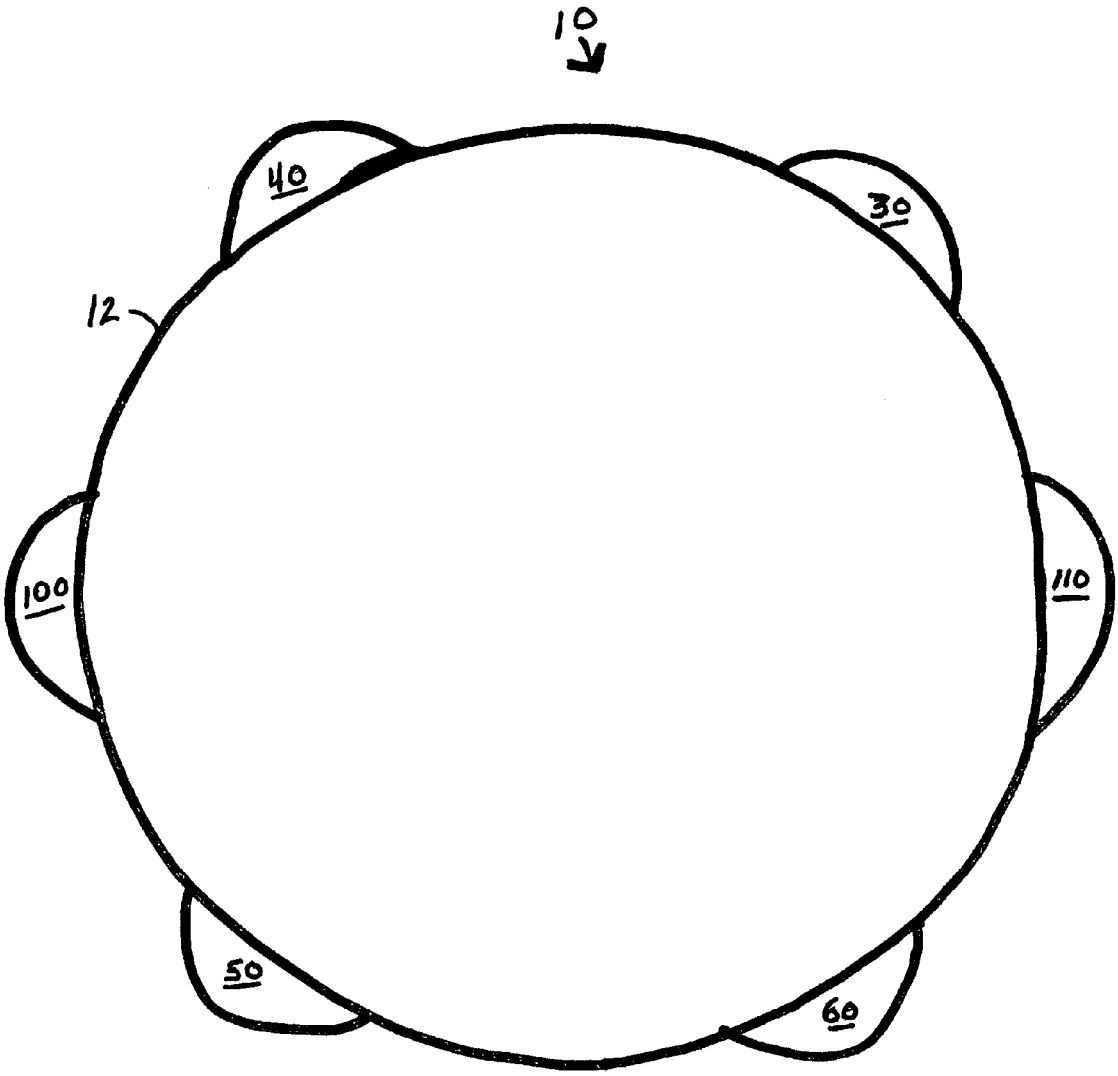
FIG. 5 shows a plan view of the display insert 10 having six tabs.

Even though FIGS. 1 and 3 show a display 10 having a total of four tab sections 30, 40, 50, and 60, the display may have any number of tabs. For example, the display can have three tabs, which would be useful for smaller tires. In contrast, and as shown in FIG. 5, the display 10 may have six tab sections 30, 40, 50, 60, 100, and 110 useful for larger sized tires such as truck and sport utility vehicle tires having an opening in their center 22" or larger. Tab sections 110 and 111 provide additional support for the display 10 for larger sized tires. Of course, it is contemplated that the display 10 can have number of tabs including fewer than three or greater than six in order to hold the display in place in the center of the tire.

The display insert can be formed from a variety of materials such as corrugated materials, styrene, polystyrene, solid bleached sulfate (SBS), plastic, foam core, and recycled or unrecycled paperboard. Preferably, at least a portion of the front panel section 10 and back panel section 20 are formed from a corrugated material. Corrugated material is preferred because of its flexibility and exceptional strength-to-weight ratio properties. Also, the surface of corrugated material is suitable for printing. Corrugated material is generally formed from a paper product but can be formed from other materials including plastics. Preferably, the front panel section 10 also includes a lithograph layer that can include graphics and text that can be attached to any of the above-mentioned materials.

Figure 4A:
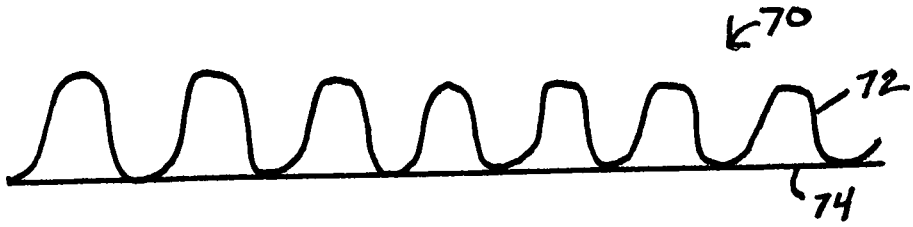
FIGS. 4A-4C show cross-sectional views of corrugated material that can be used for the display insert.
Figure 4B:
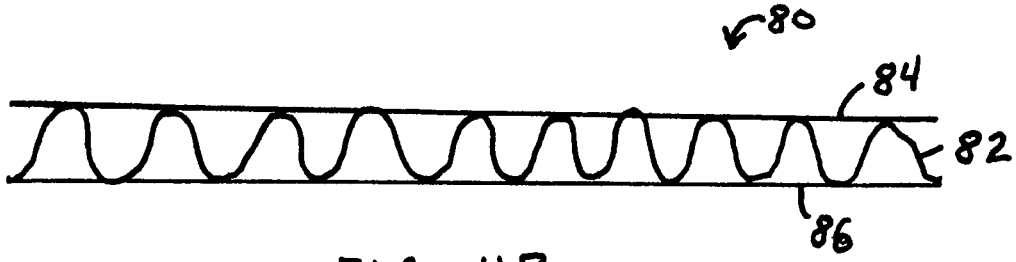
Figure 4C:
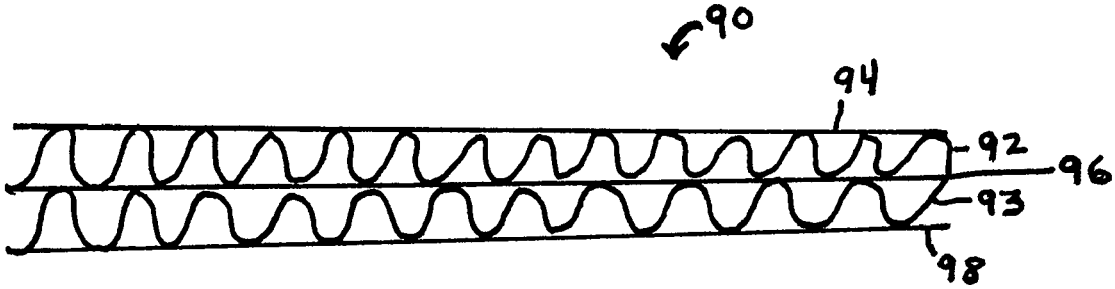

FIGS. 4A-4C show examples of different types of suitable forms of corrugated material. FIG. 4A shows a particular type of corrugated material arranged in what is known as a single face 70. The single face 70 includes one flute layer 72 and one liner layer 74 attached to the flute layer 72. FIG. 4B shows a corrugated material form known as a single wall 80. The single wall 80 includes one flute layer 82 having a first liner layer 84 attached to the flute layer 82 and a second liner layer 86 attached to the flute layer 82 opposite the first liner layer 84. The second liner layer 86 provides the single wall 80 with greater strength than the single face 70. FIG. 4C shows double wall 90. The double wall 90 includes a first flute 92 and a second flute 93. The double wall 90 also includes a first liner 94 attached to the first flute 92. A second liner 96 is attached between the first flute 92 and second flute 93 and opposite the first liner 94 on the first flute 92. A third liner 98 is attached to the second flute 93 opposite the second liner 96. Although the present display can use the single face 70, single wall 80, or double wall 90 forms as the corrugated material, it is contemplated that any number of liners and flutes can be used in any combination. The number of flutes and liners can vary, as can the flute and/or liner sizes and thicknesses.

It is preferred that the corrugated material of the front panel section 10 and back panel section 20 be positioned in a way that the length of the flute in the corrugated material for the front panel section 10 be nonparallel to the length of the flute of the corrugated material in the back panel section 20. More preferably, the length of the flute of the corrugated material for the front panel section 10 is approximately perpendicular to the length of the flute of the corrugated material for the back panel section 20.

The back panel section 20 is preferably formed as a single wall 80 as shown in FIG. 4B and having a flute, a first liner, and a second liner, where the first liner is attached to one side of the flute and the second liner is attached to the side of the flute opposite the first liner. It is preferred that the first liner and second liner of the back panel section are formed from the identical material having the same thickness and weight. The reason that the first liner and second liner are formed from identical material having the same thickness and weight is because to prevent curling of the back panel section that may occur over time due to differences in weight, thickness, and materials.

It is preferred that the front section 12 is formed from corrugated material having a single face 70 as shown in FIG. 4A and further having a lithograph layer so that it would be a single wall 80 but with the lithograph layer replacing the first liner layer 84. Thus, the preferred front section 12 would include a flute layer, a liner attached to one side of the flute layer, and a lithograph layer attached to the flute layer opposite the liner.

Figure 7:
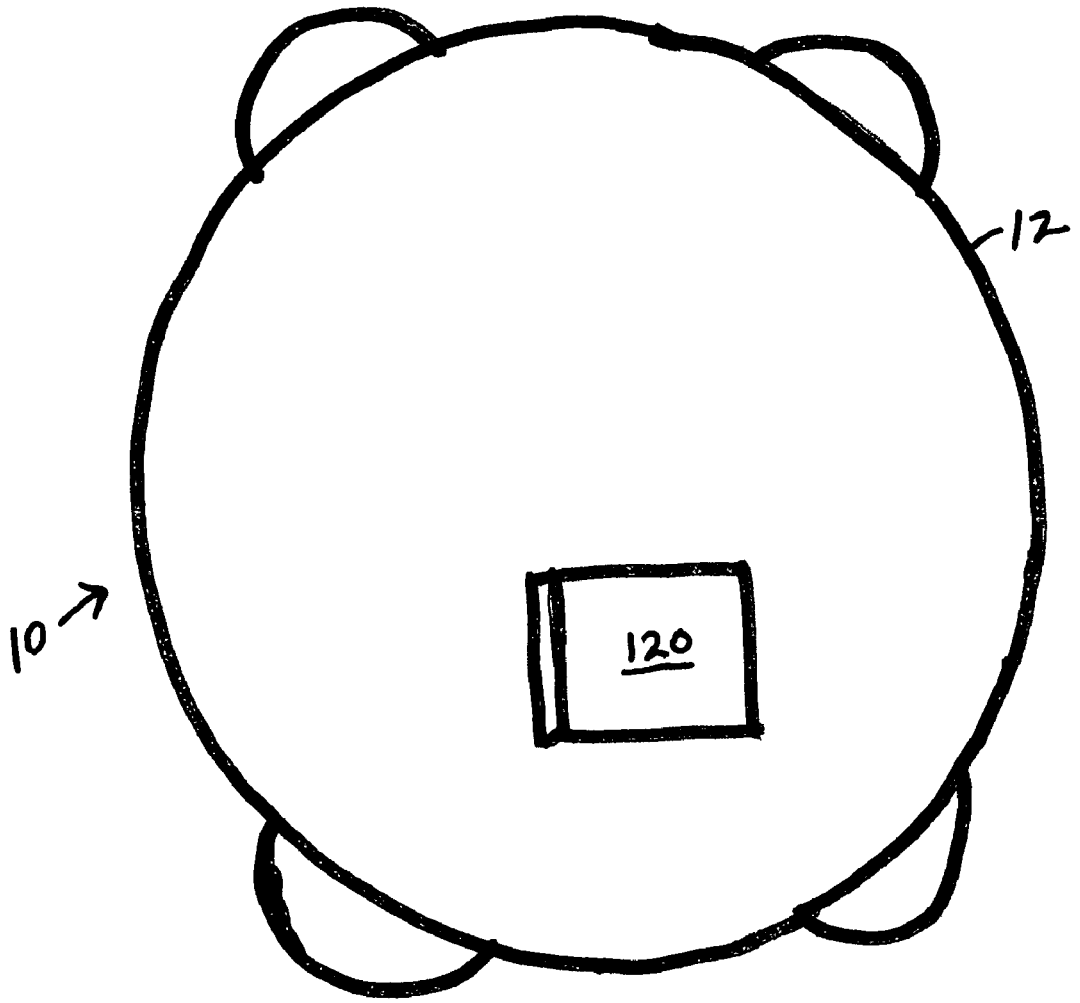
FIG. 7 shows a front perspective view of the display insert including an optional pocket 120.

The display can further include other features. One feature can be a transparent film or lamination on the surface of the lithograph layer of the top portion for protection. Another feature is a metal plate (not shown) secured on the top portion or bottom portion with an opening through the top portion so that the metal plate is visible on and flush with the top portion. The metal plate can be used for tear-away paper advertisements that include a magnet on the back portion of the advertisement that can attach to the metal plate. Another feature of the display can be a pocket for use in holding advertisement literature. FIG. 7 shows a pocket 120 on the front portion 12 of the display 10. The pocket 120 can be attached to the display 10 by any known attaching means such as tabs, glue, and tape. Preferably, the pocket 120 includes tabs (not shown) that can be inserted into slits on the front and back portions of the display to secure the pocket to the display 10.

Figure 8:
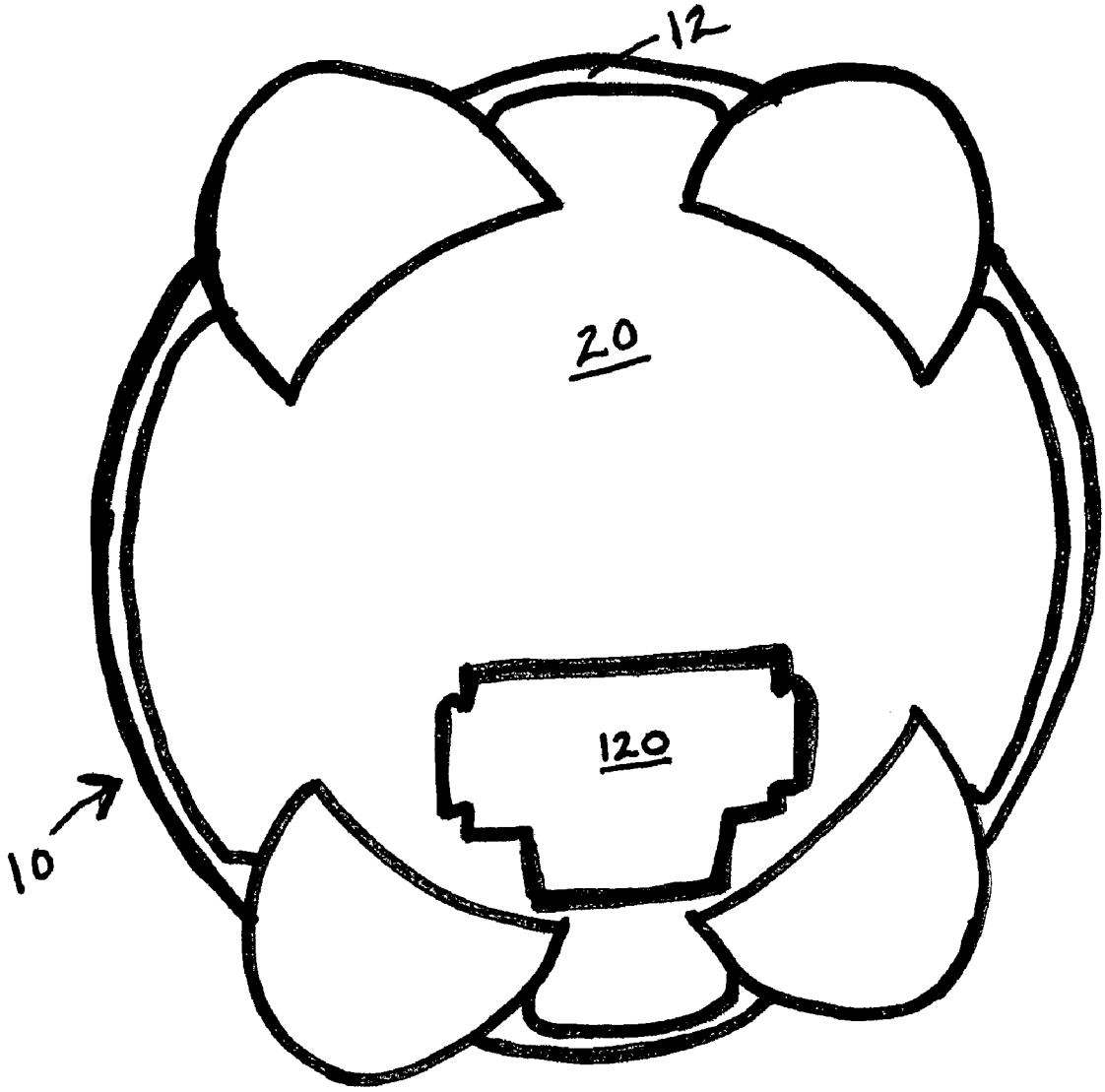
FIG. 8 shows a rear prospective view of the display insert 10 having a pocket 120 in an unassembled state.

The pocket 120 can be machined as a part of the back portion of the display so that the pocket is flat and flush with the back portion during the unassembled state. FIG. 8 shows the back portion 20 of the display 10. The back portion 20 includes the pocket 120 in a flat position on the back portion 20. The pocket 120 is perforated along its edges for easy removal. The pocket 120 can then be removed from the back portion 20, folded, and attached to the front portion 12 as shown in FIG. 7.

The preferred method of making the display is as follows. For the top portion, corrugated material is machined to form a flute. The flute is then attached to a liner on one side of the flute. A lithograph layer is also attached to the flute opposite the liner. The lithograph layer includes graphics and text. The top portion can be cut once the flute and liner are attached prior to the attachment of the lithograph layer. Alternatively, the top portion can be cut once the liner, flute, and lithograph layer are attached. The bottom portion is similarly formed although a second liner is attached to a flute instead of lithograph paper as with the top portion. The top and bottom portions can be attached in a continuous process or can be attached in distinct separate steps. Preferably, the top and bottom portions are attached in a way so that the flutes in the respective top and bottom portions are nonparallel.

In use, the four tabs 30, 40, 50 and 60 provides a spring biasing force between the tire and the display insert to provide secure support. Tabs 30, 40, 50 and 60 are bent along scored edges 31, 41, 51 and 61, respectively so that tabs 30, 40, 50 and 60 protrude outwardly away from the front panel section 12. The tire insert 10 is then inserted into the central opening of a tire so that tabs 30, 40, 50 and 60 hold the tire insert 10 in place on the tire. Tabs 30, 40, 50 and 60 also allow the display insert to be used in variably sized tires.

Figure 9:
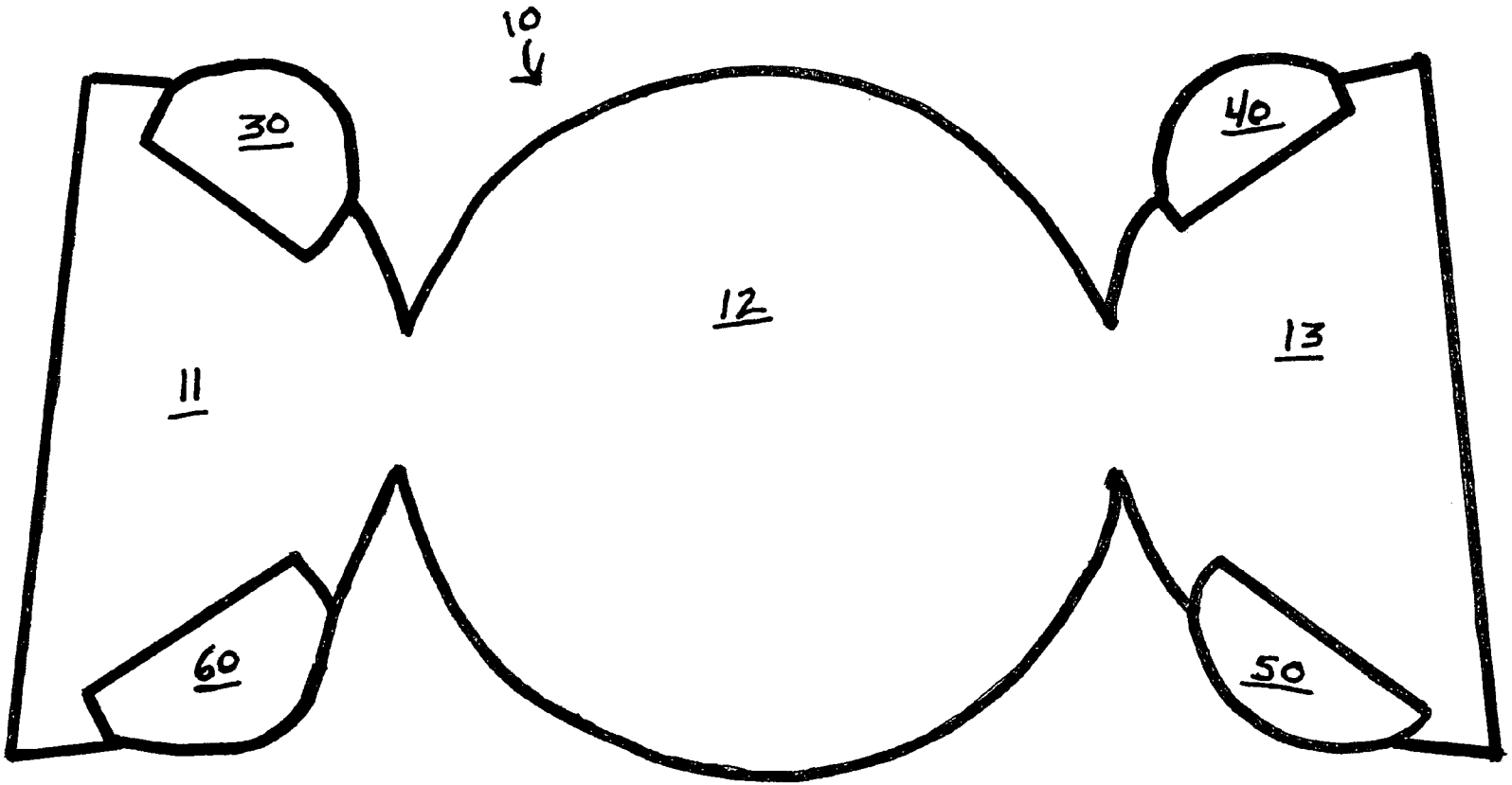
FIG. 9 shows a plan view of the display insert 10 in an unassembled state.
Figure 10:
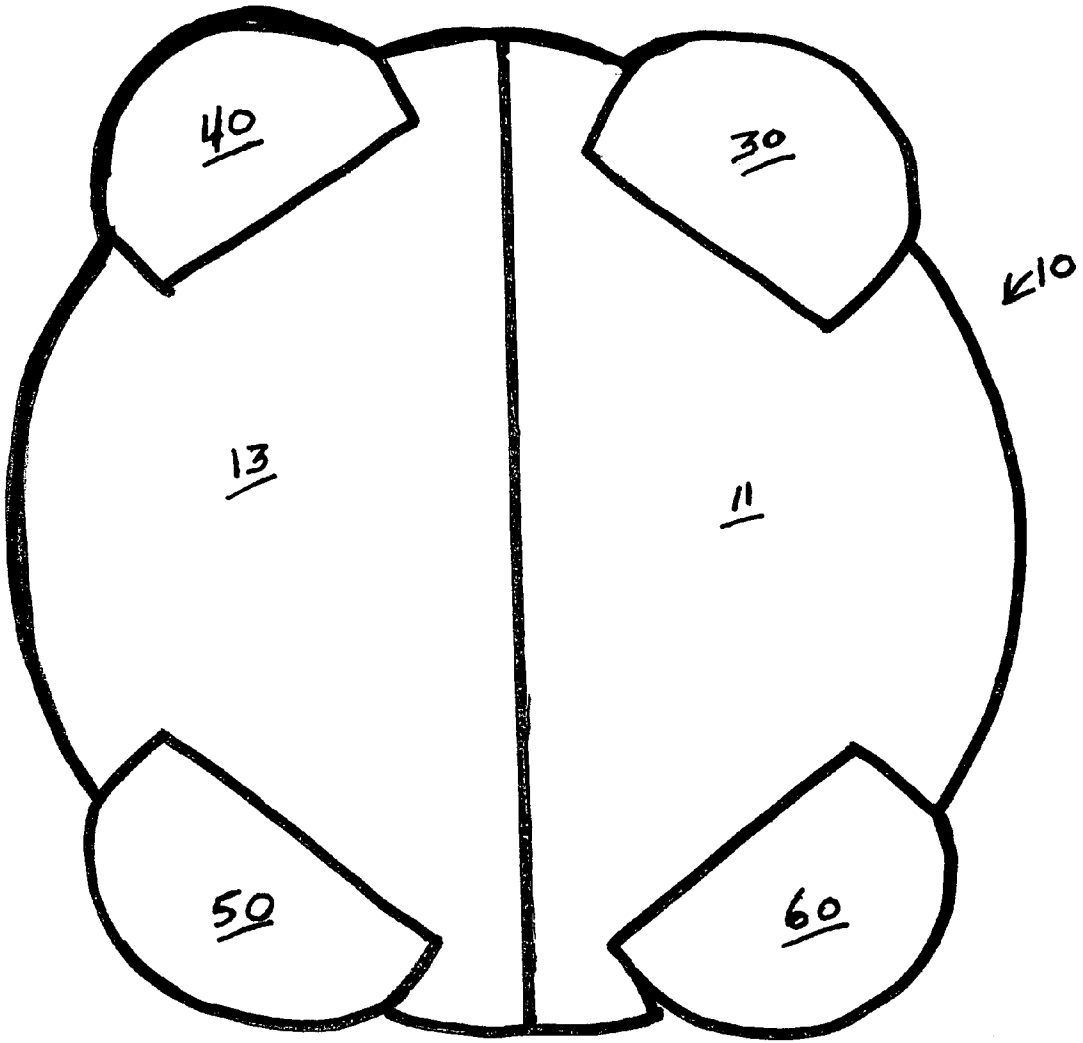
FIG. 10 shows a rear plan view of the display insert 10 in an assembled state.

FIGS. 9 and 10 show an alternate display insert 10. FIG. 9 shows the display insert 10 including a front panel section 12, a first side panel section 11 and a second side panel section 13. The first and second side panel sections 11, 13 are connected along a portion of their edges to the front panel 12. FIG. 10 shows the first and second side panel sections 11, 13 can be folded back and attached to the front panel 12 to form the assembled display insert 10. The entire display insert 10 is formed of a single unitary piece, which can later be manipulated to form the desired shape. Each of the feet 20 defines a slit 22 with respect to the panels 14, 16. As such, each foot has two straight edges 24 and a curved edge 26. Further, indented fold line 28 is utilized so that the plurality of feet 20 may be resiliently deformable to fit any tire size.

The invention has been described with reference to the preferred embodiment. Obviously, modifications and alterations will occur to others upon a reading and understanding of this specification. Any of the variables disclosed herein can readily be determined and controlled without departing from the scope of the invention herein disclosed and described. Moreover, the scope of the invention shall include all modifications and variations that fall within the scope of the attached claims.

Having therefore described the invention, it is claimed:

1. A display insert for a tire, said display insert comprising: a front panel section having at least one edge;

a back panel section connected to said front panel section, said back panel section comprising a plurality of tabs each having at least one edge, wherein the edges of at least two of said tabs are aligned and tangential with the edge of said front panel between the at least two tabs; and wherein said tabs are capable of engaging the tire to hold said front panel in a predetermined position substantially covering an opening of the tire.

2. The display insert of claim 1, wherein said front panel section is circular.

3. The display insert of claim 1, wherein said front panel section and back panel section comprise a corrugated material.

4. The display insert of claim 3, wherein said corrugated material includes at least one flute and one liner.

5. The display insert of claim 4, wherein a length of said flute for said front panel section is nonparallel to a length of said flute for said back panel section.

6. The display insert of claim 5, wherein the length of said flute for said front panel section is perpendicular to the length of said flute of said back panel section.

7. The display insert of claim 1, wherein said back panel section comprises four tabs.

8. The display insert of claim 1, wherein said front panel section comprises a pocket attached to said front panel section.

9. The display insert of claim 8, wherein said pocket is attachable to said front panel section in an assembled state or attached to said back panel section in an unassembled state.

10. The display insert of claim 1, wherein the back panel is insertable in a tire.

11. A display insert for a tire comprising: a front panel having an edge;

a back panel connected to said front panel, said back panel having a plurality of flexible tabs, each having at least one edge, wherein the edges of at least two of said tabs are aligned and tangential with the edge of said front panel between the at least two tabs; and wherein said tabs are capable of being inserted into the tire to provide a biasing force to said tire to hold said front panel in a predetermined position.

12. The display insert of claim 11, wherein said tabs comprise edges, the edges two of said tabs are aligned with an edge of said front panel between said two tabs.

13. The display insert of claim 11, wherein the front panel comprises a first corrugated material, the back panel comprises a second corrugated material, and said first corrugated material and second corrugated material comprises at least one flute and at least one liner connected to said flute, wherein the length of said flute of said first corrugated material is nonparallel to the length of said flute of said second corrugated material.

14. The display insert of claim 13, wherein the length of said flute of said first corrugated material is perpendicular to the length of said flute of said second corrugated material.

15. The display insert of claim 13, wherein said second corrugated material comprises a second liner connected to said flute opposite said liner.

16. The display insert of claim 15, wherein said liner and second liner are formed from a material having identical thickness.

17. The display insert of claim 13, wherein said first corrugated material comprises one flute, one liner connected to said flute, and one lithographic layer connected to said flute opposite said liner.

18. A display insert for a tire comprising: a front panel having an edge;

a back panel connected to said front panel, said back panel having a plurality of flexible tabs, each having at least one edge, wherein the edges of at least two of said tabs are aligned and tangential with the edge of said front panel between the at least two tabs; and wherein said back panel does not require an interlocking structure to secure said back panel within the tire.

19. The display insert of claim 18, wherein said front panel is made of a first material and said back panel is made of a second material.

20. The display insert of claim 19, wherein the first material is selected from the group consisting of styrene, polystyrene, solid bleached sulfate, plastic, foam core, and paper board and the second material is selected from the group consisting of styrene, polystyrene, solid bleached sulfate, plastic, foam core, and paper board.

* * * * *